US009657598B2

(12) United States Patent
Janvier

(10) Patent No.: US 9,657,598 B2
(45) Date of Patent: May 23, 2017

(54) IMMEDIATE RESPONSE STEAM GENERATING SYSTEM AND METHOD

(75) Inventor: Benoit Janvier, Montreal (CA)

(73) Assignee: ENERO INVENTIONS, Montreal (Quebec) (CA)

( * ) Notice: Subject to any disclaimer, the term of this patent is extended or adjusted under 35 U.S.C. 154(b) by 1344 days.

(21) Appl. No.: 12/600,308

(22) PCT Filed: May 17, 2007

(86) PCT No.: PCT/CA2007/000874

§ 371 (c)(1),
(2), (4) Date: Nov. 16, 2009

(87) PCT Pub. No.: WO2008/141410

PCT Pub. Date: Nov. 27, 2008

(65) Prior Publication Data

US 2010/0154725 A1 Jun. 24, 2010

(51) Int. Cl.
*F22B 1/00* (2006.01)
*F01K 1/00* (2006.01)
(Continued)

(52) U.S. Cl.
CPC ..... *F01K 1/00* (2013.01); *F01K 1/08* (2013.01); *F01K 3/00* (2013.01); *F01K 13/02* (2013.01); *F22B 3/04* (2013.01)

(58) Field of Classification Search
CPC ..... F01K 3/00; F01K 3/18
(Continued)

(56) References Cited

U.S. PATENT DOCUMENTS 1,770,256 A * 7/1930 Smekal ..... 60/659
1,890,468 A * 12/1932 Noack ..... F01K 13/00 122/1 R
(Continued)

FOREIGN PATENT DOCUMENTS

CH 158028 A 10/1932
DE 670557 C 1/1939
(Continued)

OTHER PUBLICATIONS

Japanese Office Action for JP application 2010-507768; Issued Jun. 18, 2012; Citing references JP2004236991; JP9512879; JP5650204; JP59136505.
International Search Report; PCT/CA2007/000874; Feb. 15, 2008.

*Primary Examiner* — Alissa Tompkins
*Assistant Examiner* — John Bargero
(74) *Attorney, Agent, or Firm* — Cantor Colburn LLP

(57) ABSTRACT

The method of generating immediate and thereafter continuous steam is used in a steam generating system comprising a steam accumulator, a steam outlet connected to the steam accumulator, an outlet valve at the steam outlet, and a quick response steam generator unit connected to the steam accumulator. The method comprises the steps of providing latent steam in the steam accumulator, opening the outlet valve to allow latent steam in the steam accumulator to exit through the steam outlet, feeding water to the steam generator unit, heating the water fed to the steam generator unit while the latent steam exits through the steam outlet and, before the latent steam has entirely exited the steam accumulator, generating steam with the steam generator unit to feed the steam accumulator and controlling the steam flow rate through the steam outlet to maintain it at a value which is essentially not greater than the steam flow rate from the steam generator unit to the steam accumulator. The steam generating system is capable of generating immediate and thereafter continuous steam from an initial steam generator unit cold condition due to the steam accumulator providing steam at the steam outlet while the steam generator unit heats the water fed therein.

9 Claims, 1 Drawing Sheet

(51) Int. Cl.

| | |
|---|---|
| ***F01K 1/08*** | (2006.01) |
| ***F01K 3/00*** | (2006.01) |
| ***F01K 13/02*** | (2006.01) |
| ***F22B 3/04*** | (2006.01) |

(58) Field of Classification Search
USPC ..... 122/35; 60/646, 652, 676
See application file for complete search history.

(56) References Cited

U.S. PATENT DOCUMENTS

| | | | | | |
|---|---|---|---|---|---|
| 3,890,789 | A | * | 6/1975 | Beckmann et al. | 60/659 |
| 4,145,995 | A | | 3/1979 | Kato | |
| 4,555,905 | A | * | 12/1985 | Endou | F01K 3/02 60/659 |
| 5,080,047 | A | * | 1/1992 | Williams et al. | 122/35 |
| 5,896,746 | A | * | 4/1999 | Platell | 60/618 |
| 2010/0083666 | A1 | * | 4/2010 | Brook et al. | 60/780 |

FOREIGN PATENT DOCUMENTS

| | | | | |
|---|---|---|---|---|
| EP | 1584798 | A1 | | 10/2005 |
| FR | 1516240 | | | 1/1968 |
| GB | 218044 | | * | 7/1924 |
| GB | 489363 | | * | 7/1938 |
| JP | 5650204 | A | | 5/1981 |
| JP | 59136505 | | | 8/1984 |
| JP | 2004236991 | | | 8/2004 |

* cited by examiner

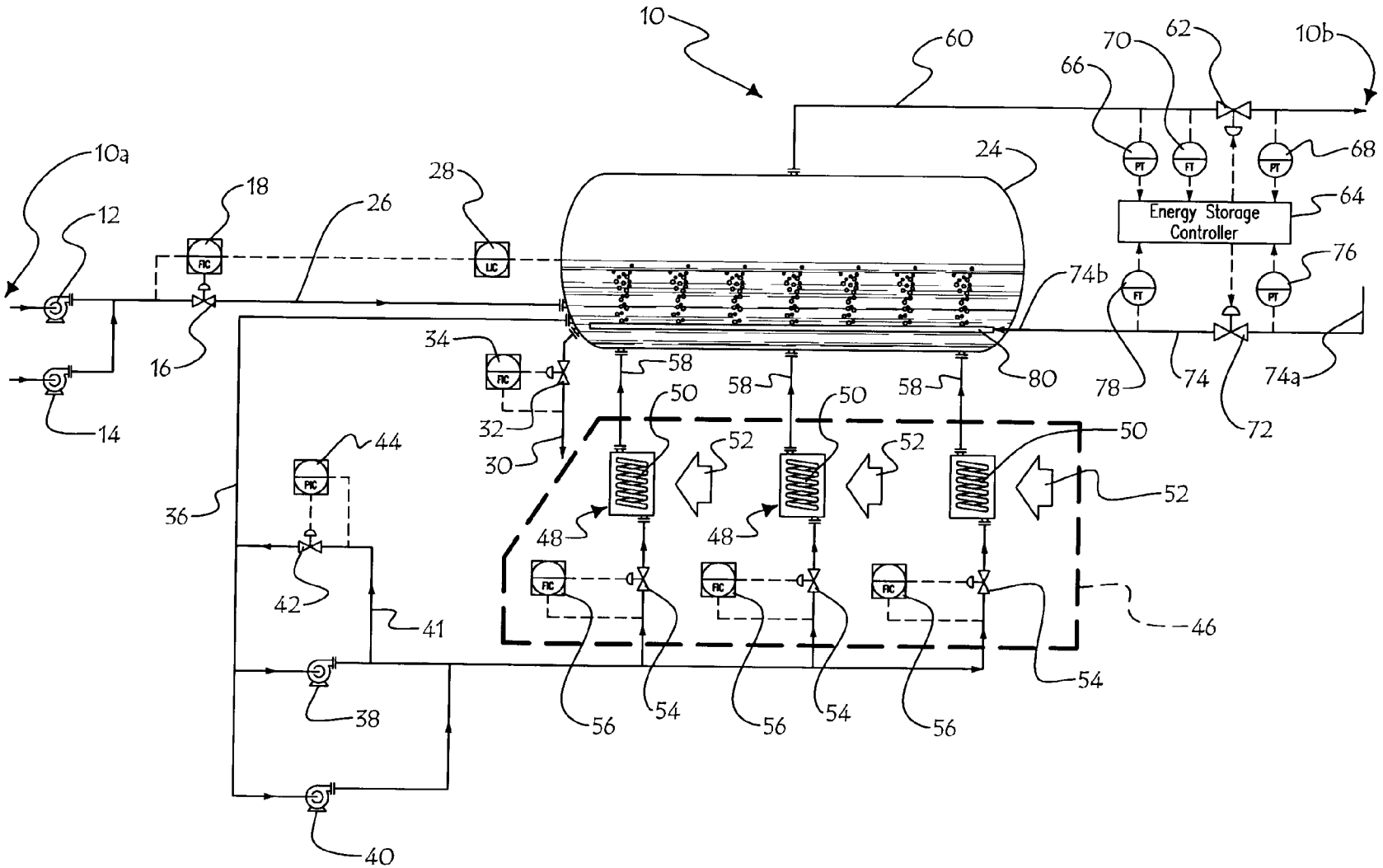
Energy Storage Controller
10
10a
10b
12
14
16
18
24
26
28
30
32
34
36
38
40
41
42
44
46
48
50
52
54
56
58
60
62
64
66
68
70
72
74
74a
74b
76
78
80

IMMEDIATE RESPONSE STEAM GENERATING SYSTEM AND METHOD

FIELD OF THE INVENTION

The present invention relates to steam generating systems and methods, and more particular to an immediate response steam generating system and method for generating immediate and thereafter continuous steam.

BACKGROUND OF THE INVENTION

Steam generating systems are used in plants and similar industrial areas to produce steam which will be used for a plethora of different purposes. Plants that use steam as an energy source are often referred to as steam plants.

Conventional steam generators include a boiler or burner system that will produce heat around pipes carrying water thus transformed from liquid-phase to gazeous-phase. It takes some time to initiate a conventional high-output heat generating system. The initiation of a steam generating system is hereby defined as heating the steam generating system from a cold condition to a temperature that allows steam to be outputted at a desired industrial flow rate. As is known in the art, the cold condition of a steam generating system refers to its initial condition where the burner is not operational and where the boiler tubes are not at operating pressure and temperature values, or more generally where the steam generating system is not yet operational, i.e. it is not in steam production mode. The steam generating system initiation time, which thus includes a warm-up time, can be for example 30 to 60 minutes or more. If the steam generating system becomes inoperative due to some mechanical failure, then another back-up or auxiliary steam generating system may be provided to take up the steam generating task; however, waiting 30 to 60 minutes for the auxiliary steam generating system to be initiated is unacceptable since the plant operations cannot wait that long. One alternative is to have the auxiliary steam generating system operating at all times at low firing rate (low load), which is expensive and very energy inefficient (uselessly consumes resources).

It is noted that the 30 to 60 minutes of time to initiate a conventional boiler or heat generating system is usually not related to the steam output flow (debit) rate. Indeed, this initiation delay relates mostly to the time that is required to accommodate the thermally-induced mechanical stresses in the structure of the boiler. By heating the water at high temperatures through the boiler tubes, the latter are subjected to very important temperature gradients which stress the structure through its thermal expansion; furthermore, the water itself, when vaporized into steam, is the object of a very significant volumetric increase. Both of these physical phenomena require that the temperature gradients be managed diligently to prevent mechanical failure of the boiler, and this management includes delaying the vapor production over time, usually over about one hour, before the boiler may operate in a normal industrial steam production mode.

SUMMARY OF THE INVENTION

The present invention relates to a method of generating immediate and thereafter continuous steam in a steam generating system comprising a steam accumulator, a steam outlet connected to said steam accumulator, an outlet valve at said steam outlet, and a quick response steam generator unit connected to said steam accumulator, said method comprising the following steps:

- providing latent steam in said steam accumulator;
- opening said outlet valve to allow latent steam in said steam accumulator to exit through said steam outlet;
- feeding water to said steam generator unit;
- heating the water fed to said steam generator unit while said latent steam exits through said steam outlet; and
- before said latent steam has entirely exited said steam accumulator, generating steam with said steam generator unit to feed said steam accumulator and controlling the steam flow rate through said steam outlet to maintain it at a value which is essentially not greater than the steam flow rate from said steam generator unit to said steam accumulator;

wherein said steam generating system is capable of generating immediate and thereafter continuous steam from an initial steam generator unit cold condition due to said steam accumulator providing steam at said steam outlet while said steam generator unit heats the water fed therein.

In one embodiment, before said outlet valve is opened, said latent steam is maintained at determined idle pressure and temperature values in said steam accumulator whereby liquid state water and gaseous state steam coexist in said steam accumulator to form said latent steam, and wherein upon said outlet valve being opened, the pressure in said steam accumulator will gradually drop whereby a portion of the liquid state water will gradually flash into steam.

In one embodiment, said idle pressure and temperature values in said steam accumulator are maintained by inputting steam through an auxiliary steam line.

In one embodiment, water fed to said steam generator unit is fed from said steam accumulator, and wherein a water input line is further connected to said steam accumulator to feed water to said steam accumulator, whereby water fed to said steam generator unit is preheated by its passage through said steam accumulator.

In one embodiment, said steam generator unit comprises at least one coil boiler in which water is circulated through coil-shaped pipes.

In one embodiment, most of the water mass circulated through said coil-shaped pipes is maintained in liquid-state even when steam is generated by said coil boiler.

In one embodiment, between 70% and 97% of the water mass circulated through said coil-shaped pipes is maintained in liquid-state even when steam is generated by said coil boiler.

The present invention further relates to a steam generating system for generating steam, comprising:

- a steam accumulator having a steam outlet;
- a quick-response steam generator unit connected to said accumulator wherein steam generated from said steam generator unit is fed to said steam accumulator;
- a steam outlet valve at said steam outlet, controlling the steam flow rate out of said accumulator; and
- a steam generator unit water inlet connected to said steam generator;

wherein said steam generating system is capable of generating immediate and thereafter continuous steam from an initial steam generator unit cold condition due to said steam accumulator providing steam at said steam outlet while said steam generator unit heats the water fed therein.

In one embodiment, said steam accumulator comprises an idle pressure/temperature maintaining device.

In one embodiment, said idle pressure/temperature maintaining device includes an auxiliary steam line connected to a steam source, said auxiliary steam line having a steam inlet connected to said steam accumulator for allowing steam to be injected into said steam accumulator.

In one embodiment, said steam generator unit comprises at least one coil boiler having coil-shaped pipes capable of accommodating thermally-induced mechanical stresses.

In one embodiment, said steam generator unit water inlet is connected to said steam accumulator, and said steam generating system comprises a system water inlet connected to said steam accumulator for feeding water thereto, whereby the water fed to said steam generator unit is first mixed with water from the said steam accumulator.

DESCRIPTION OF THE DRAWINGS

The annexed single FIGURE represents a schematic view of an immediate response steam generating system according to the present invention, connected to the water/steam line of a steam plant.

DETAILED DESCRIPTION OF THE EMBODIMENTS

FIG. 1 shows an immediate response steam generating system 10 according to the present invention, for use in a desired location such as a steam plant. Steam generating system 10 comprises at an upstream end 10*a* thereof a pair of facultative water inlet pumps 12, 14 pumping in boiler feedwater originating from a the steam plant although it is understood that alternate water source(s) such as a municipal water supply or water from the steam plant deaerator could be linked at the upstream end 10*a* of steam generating system 10. Usually the water/steam in a steam plant will be circulated in a closed loop with make-up water from the water treatment facility being added to the steam condensate circuit to account for water and steam losses, but it is not outside the scope of the present invention to generate steam for other open-ended applications if an external water input is provided.

Steam generating system 10 also defines a downstream end 10*b* where steam is to be generated, for use in the steam plant applications or in any desired steam-enabled application.

Water inflow rate at the system upstream end 10*a* is controlled by means of a system water inlet valve 16 linked to an inlet valve controller 18, to selectively allow water to be fed into a steam accumulator 24 along a water inlet pipe 26. Steam accumulator 24 is more particularly in the form of a thermally insulated tank, and is equipped with an accumulator parameter detector 28 that detects the water level in steam accumulator 24 and is linked to inlet valve controller 18 to automatically allow water into steam accumulator 24 when the water level therein reaches a predetermined lower threshold value. Accumulator parameter detector 28 also detects pressure and temperature values within accumulator 24.

Steam accumulator 24 is conventionally equipped with a maintenance drain pipe 30 having a drain valve 32 controlled by a drain valve controller 34.

Steam accumulator 24 is connected to a water outlet pipe 36 having a pair of coil boiler pumps 38, 40 mounted in parallel therealong (a single pump could be used) to feed water into a steam generator unit 46 comprising a number of coil boilers 48, e.g. three coil boilers 48 as illustrated.

A recirculation pipe 41 equipped with a recirculation valve 42 controlled by a recirculation controller 44 allows a minimum flow rate through pumps 38, 40 at all times when they are activated. Consequently, even if the water flow rate out of accumulator 24 is low, damage to pumps 38, 40 will be avoided, for example if a system malfunction was to occur and pumps 38, 40 were to pump on an empty supply.

Each coil boiler 48 comprises coil-shaped tubes 50 through which the water is channelled. The coil boilers 48 are subjected to intense heat as schematically illustrated by arrows 52, for example from a combustion-resulting flame as is conventionally known in the art, although alternate heating means could also be envisioned such as from another high temperature fluid that is allowed to flow against the outer surface of the coil boiler pipes 50.

The water inlet of each coil boiler 48 is connected to a coil boiler inlet valve 54 which is in turn controlled by a coil boiler water inlet controller 56 to control the water flow rate into coil boilers 48 and consequently the steam outlet flow rate out of coil boilers 48.

Coil boilers 48 are of known construction, although they are seldom used for boilers having a capacity exceeding 50,000 pounds per hour. Indeed, coil boiler-type steam generators are conventionally known to be low-output systems, and are consequently considered impractical systems for steam plants. However, coil boilers have the advantage of allowing a very fast response time for generating steam, due to the coil configuration of their pipes. This coil configuration allows considerable leeway for thermal expansion, which allows the coil boiler to accommodate significant thermally-induced mechanical stresses in the coil pipes 50 of the coil boilers 48. As a result, coils 50 can be subjected to sudden temperature gradients from heat sources 52 that are much more important than in conventional high-output steam generators. These important temperature gradients allow for steam to be generated much more quickly in coil boilers 48, albeit perhaps not as efficiently as a high-output boiler over a long period of time. As indicated hereinabove, it is frequent for steam generators to take between 30 and 60 minutes or more to generate steam when they are initiated, whereas coil boilers can generate steam within 5 to 10 minutes when they are initiated (i.e. from a cold state to a fully operative, steam production mode). Coil boilers 48 are consequently considered to constitute a quick-response steam generator unit, in that they take significantly less than the usual 30-60 minutes or more to generate steam when they are initiated.

The outlet of each coil boiler 48 is linked with a coil boiler outlet pipe 58 to steam accumulator 24. Thus, steam generated by steam generator unit 46 is fed into steam accumulator 24, and water flowing out of steam generator unit 46 is likewise fed into steam accumulator 24. It is noted that although coil boilers 48 are said to generate steam, this does not exclude that a portion of the water fed into coil boilers 48 will exit coil boilers 48 in liquid state, as discussed hereinafter. In other words, according to one embodiment, not all water fed into coil boilers 48 will be transformed into steam.

A system steam outlet pipe 60 is linked to steam accumulator 24 and is equipped with a system steam outlet valve 62 at the system downstream end 10*b*. *System steam outlet valve* 62 *is controlled by an energy storage controller* 64 *which detects pressure values upstream and downstream of system steam outlet valve* 62 *by means of pressure controllers* 66, 68 *and volumetric flow rate values from a flow controller* 70 *upstream of valve* 62.

Energy storage controller 64 will also control a valve 72 installed on a higher pressure auxiliary steam line 74 from which pressure and volumetric flow rate values can be determined with an auxiliary line pressure controller 76 and an auxiliary line flow controller 78. Auxiliary steam line 74 has an upstream end 74*a* which is connected to an external steam source. Auxiliary steam line 74 has a downstream end 74*b* which is connected to steam accumulator 74.

In use, steam generating system 10 is said to be an immediate response steam generating system because it can generate steam immediately upon demand. This is particularly advantageous in circumstances where a lack of steam can have disadvantageous consequences. For example, in some steam plants, if the main steam generators trip, i.e. if they cease to function for some reason, the entire plant operations will often be stopped entirely for hours, and in some cases the plant process equipment that requires steam on a continuous basis can be damaged as a consequence of a loss in steam production. Thus, having an auxiliary steam generating system capable of immediate steam generation as a back-up system is highly desirable. This auxiliary steam generating system should also be capable of generating steam in a continuous fashion as of the time where it is initiated, to feed steam to the steam plant until the main steam generators are back online.

In this particular case, steam generating system 10 is intended for auxiliary use and is capable of immediate and thereafter continuous steam generation. This will be accomplished as follows.

In an idle state, when no steam demand exists and when system steam outlet valve 62 is closed, steam accumulator 24 is loaded with a mix of saturated steam and water at determined idle pressure and temperature values. More particularly, the idle accumulator pressure will be set at a high value, so as to maintain most of the water in accumulator 24 in liquid state, for allowing a greater storage capacity at a lesser volume. Although in ideal conditions of thermal insulation and pressure control these idle parameters could remain stable, in reality it is desirable to use auxiliary steam line 74 to allow steam into accumulator 24 through a steam outlet manifold 80 to compensate the inevitable pressure/temperature loss over time. The pressure value in accumulator 24 being monitored at all times by accumulator parameter detector 28, energy storage controller 64 (connected to accumulator parameter detector 28) is capable of controlling the steam input required in accumulator 24 to maintain a determined idle pressure value therein. In this idle condition of system 10, coil boilers 48 are not operational and steam generator unit is in a cold condition. Furthermore, no water circulates through water inlet pipe 26 or water outlet pipe 36.

When immediate and thereafter continuous steam is requested, system steam outlet valve 62 is controlled by energy storage controller 64 to be opened. Steam present in accumulator 24 is immediately exhausted, resulting in an immediate pressure drop within accumulator 24. This results in the water flashing into steam in accumulator 24, since the pressure decrease results in a boiling point temperature decrease also. This means that steam is generated in accumulator 24 from the water therein, with this steam being allowed to exit through steam outlet pipe 60. It is noted that the steam present in accumulator 24 before system steam outlet valve 62 is opened is likely to represent a marginal or even insignificant portion of the steam which will be exhausted when system steam outlet valve 62 is opened; however, its role is important as it contributes to maintain the idle pressure and temperature values in accumulator 24. The combination of the steam present in accumulator 24 in its idle condition, and the liquid-state water which flashes into steam upon the pressure decreasing in accumulator 24 after system steam valve 62 is opened, is referred to herein as latent steam. Indeed, although liquid-state water would not normally be referred to as steam, in this case it is appropriate to refer to it as latent steam since as soon as the pressure decreases in accumulator 24 under normal operation of steam generating system 10, this liquid-state water will flash part of its content into steam. The proportion of steam generated from water is a function of the initial accumulator pressure, the final accumulator pressure and the amount of initial saturated water stored in the accumulator.

Simultaneously to the steam outlet valve 62 being opened, steam generator unit 46 will be initiated from its initial cold condition upon steam being requested from system 10. More particularly, liquid-state water will be fed from water inlet line 26 into steam accumulator 24, and liquid-state water will also be circulated from accumulator 24 into coil boilers 48 where it will be subjected to intense heat conditions to transform part of the water into steam. For example, about 3% to 30% in mass of the water circulated in coil boilers 48 will exit coil boilers 48 as steam, the rest remaining liquid-state water; although it is understood that this percentage could be more or less than indicated hereinabove. This liquid/steam ratio is obtained by having a high pressure value in coil boilers 48 to maintain most of the water in liquid-state even though the heating temperature in coil boilers 48 is important. Maintaining a high proportion in mass of liquid-state water in the pipes of coil boilers 48 allows the coil boilers to be subjected to lesser thermally-induced mechanical stresses than if a higher proportion of water was allowed to be transformed into the low-density steam which occupies important an volume for a same mass of $H_2O$ particles. It is noted however that any alternate desired liquid/steam ratio could be obtained.

It is further noted that water fed to coil boilers 48 originates from accumulator 24 instead of being fed directly from water inlet pipe 26. This is desirable to reduce the mechanical stresses in coil boiler pipes 50. Indeed, part of the liquid-state water in accumulator 24 is preheated by its circulation through coil boilers 48, compared to the cold inlet water from pipe 26, and consequently the temperature gradient between the inputted water and the outputted water/steam will be less important than if the cold water from inlet pipe 26 was used to feed coil boilers 48 directly.

As noted above, coil boilers 48 can have an initiation time of approximately 5-10 minutes, meaning that it can take about 5-10 minutes before steam is generated from coil boilers 48 in full steam-production mode once they are activated from a cold condition. During this coil-boiler initiation period, system 10 obtains steam from the latent steam present in accumulator 24. Consequently, it is the combination of a quick-response steam generator unit 46 and a steam accumulator 24 which allows steam to be generated immediately and continuously as of the moment when it is initially requested from system 10. It is noted that steam generating system 10 is capable of generating immediate and thereafter continuous steam from an initial steam generator unit 46 cold condition due to the steam accumulator providing steam at system steam outlet 10*b* while steam generator unit 46 heats the water fed therein. It is further noted that the system steam outlet valve 62 plays an important role in keeping the steam outlet pipe 60 closed to maintain the idle pressure/temperature values in accumulator 24 when no steam is requested. Steam outlet valve 62 further controls the output debit flow rate of steam to ensure that, in steam production mode, the steam flow rate through the steam outlet 10*b* will essentially not be greater than the steam flow rate from steam generator unit 46 to steam accumulator 24. This is important since otherwise the pressure in accumulator 24 would decrease until too little or no steam at all remains in steam accumulator 24, effectively preventing steam generation at downstream end 10*b*.

Also, what is meant in the present application by stating that the steam flow rate through the steam outlet 10*b* will essentially not be greater than the steam flow rate from steam generator unit 46 to steam accumulator 24, is that the steam flow rate out of accumulator 24 at steam outlet 10*b* may in fact be greater than that from steam generator unit 46, but only temporarily. This can be desirable for example to accommodate a temporary increase in steam demand. This will result in a pressure drop in accumulator 24, since the steam input would not compensate the steam output therein. As long as the pressure within accumulator 24 remains above an operational threshold to allow steam to be outputted, this pressure drop is acceptable. Thus, although the steam flow rate at steam outlet 10*b* will usually not be greater than the steam flow rate out of steam generator unit 46, it may happen that it will in fact be temporarily greater, and it can thus be said that the steam flow rate through the steam outlet 10*b* will essentially not be greater than the steam flow rate from steam generator unit 46 to steam accumulator 24.

The steam production ratio at the system downstream end 10*b* versus at the steam generator unit outlet, will thus always be equal to 1.0 or lower. If the steam flow rate is equal at the system downstream end 10*b* and at the steam generator unit 46 outlet, then there is no steam accumulation in accumulator 24. However, it is possible to gradually load accumulator 24 with steam by controlling the relative steam flow rates at the steam generator unit 46 outlet and at the system outlet 10*b*, to have a greater steam flow rate at the steam generator unit 46 outlet. By thus accumulating steam within accumulator 24, when system steam outlet valve 62 is closed once again once no more steam is requested from system 10, accumulator 10 is loaded with latent steam once again and is ready to be used to generate immediate and thereafter continuous steam. Of course, it is also possible to load accumulator 24 partly or entirely after system steam outlet valve 62 is closed.

wherein said steam generating system is capable of generating immediate and thereafter continuous steam from an initial steam generator unit cold condition due to said steam accumulator providing steam at said steam outlet while said steam generator unit heats the water fed therein.

Any modification to the present invention which would be considered obvious to someone skilled in the art, is considered to be included within the scope of the appended claims.

For example, coil boilers 48 could be fed directly with water instead of being fed from accumulator 24. In other words, water inlet pipe 26 could be linked directly to coil boilers 48 instead of being directed to accumulator 24. This is not optimal however, since in production mode coil boilers 48 are preferably fed with pre-heated water from accumulator 24 instead of cold water from water inlet pipe 26, to reduce the mechanical stresses in coil boiler pipes 50.

Also, although coil boilers appear as the most efficient quick-response steam generator devices and as such their use within the steam generating system of the present invention is considered as an inventive concept in itself, they could be replaced by another quick-response steam generator unit, for example an electrical boiler wherein electrical current circulated between an anode and a cathode through the water itself would create steam.

An alternate pressure/temperature maintaining device could be provided on steam accumulator 24, instead of auxiliary steam line 74. For example, a heating electric resistance could run within accumulator 24, or one or all coil boilers 48 could be used in a low-output condition to maintain desired idle temperature/pressure values within accumulator 24 in its idle condition.

Although the invention has been described herein for generating steam from liquid-state water, it could be used alternately to generate gazeous state fluids from liquids other than water.

The invention claimed is:

1. A method of generating immediate and thereafter continuous steam in an auxiliary steam generating system backing-up a main steam system having a main steam temperature and pressure, the auxiliary steam generating system comprising a steam accumulator, a steam outlet connected to said steam accumulator, an outlet valve at said steam outlet connected to the main steam system, and a quick response steam generator unit connected to said steam accumulator, said method comprising the following steps:

providing a latent steam in said steam accumulator at an idle pressure and a temperature higher than that of the main steam system;

opening said outlet valve when the immediate and thereafter continuous steam is requested from the main steam system, to allow the latent steam in said steam accumulator to exit through said steam outlet towards the main steam system, the latent steam becoming the immediate and thereafter continuous steam;

feeding water to said steam generator unit, wherein water fed to said steam generator unit is fed from said steam accumulator;

heating the water fed to said steam generator unit that exits the steam generator unit as liquid-state water that flashes and becomes latent steam in the accumulator, the latent steam exiting through said steam outlet as the immediate and thereafter continuous steam and the steam generator unit comprises at least one coil boiler comprising coil-shaped pipes in which the water fed is circulated and from 3% to 30% by mass of the water fed to the at least one coil boiler exits as steam; and before said latent steam has entirely exited said steam accumulator as the immediate and thereafter continuous steam, controlling the steam flow rate through said steam outlet to maintain the steam flow rate at a value which is essentially not greater than the steam flow rate from said steam generator unit to said steam accumulator;

thereby said auxiliary steam generating system generates immediate and thereafter continuous steam from an initial steam generator unit cold condition due to said steam accumulator providing steam at said steam outlet while said steam generator unit heats the water fed therein, and wherein the steam generator unit generates steam from the initial steam generator unit cold condition to a full steam production mode of the steam generator unit in 5 to 10 minutes and to maintain the main steam system at the main steam temperature and pressure.

2. A method of generating immediate and thereafter continuous steam as defined in claim 1, wherein said idle pressure and temperature in said steam accumulator are maintained by inputting steam through an auxiliary steam line.

3. A method of generating immediate and thereafter continuous steam as defined in claim 1, wherein a water input line is further connected to said steam accumulator to feed water to said steam accumulator, whereby water fed to said steam generator unit is preheated by its passage through said steam accumulator.

4. A method of generating immediate and thereafter continuous steam as defined in claim 1, wherein most of the water mass circulated through said coil-shaped pipes is maintained in liquid-state even when steam is generated by said coil boiler.

5. A method of generating immediate and thereafter continuous steam as defined in claim 4, wherein between 70% and 97% of the water mass circulated through said coil-shaped pipes is maintained in liquid-state even when steam is generated by said coil boiler.

6. An auxiliary steam generating system for generating steam to back-up a main steam system having a main steam temperature and pressure, auxiliary steam generating system comprising:

a steam accumulator at an idle pressure and temperature higher than that of the main steam system, the steam accumulator having a steam outlet;

a quick-response steam generator unit connected to said accumulator wherein water is fed from the steam accumulator to the steam generator and exits a liquid-state water from said steam generator unit and is returned to said steam accumulator;

a steam outlet valve at said steam outlet connected to the main steam system, controlling the steam flow rate out of said steam accumulator, the outlet valve opens when the steam to back-up the main steam system is requested, and the steam generator unit comprises at least one coil boiler comprising coil-shaped pipes in which the water fed is circulated and from 3% to 30% by mass of the water fed to the at least one coil boiler exits as liquid-state water; and a steam generator unit water inlet connected to said steam accumulator; wherein said auxiliary steam generating system is capable of generating immediate and thereafter continuous steam from an initial steam generator unit cold condition due to said steam accumulator providing steam at said steam outlet while said steam generator unit heats the water fed therein and the auxiliary steam generating system generating steam at a steam flow rate through said steam outlet valve at a value which is essentially not greater than the steam flow rate from said steam generator unit to said steam accumulator, and wherein the steam generator unit generates steam from the initial steam generator unit cold condition to a full steam production mode of steam generator unit in 5 to 10 minutes, and to maintain the main steam system at the main steam temperature and pressure.

7. A steam generating system as defined in claim 6, wherein said steam accumulator comprises an idle pressure/temperature maintaining device.

8. A steam generating system as defined in claim 7, wherein said idle pressure/temperature maintaining device includes an auxiliary steam line connected to a steam source, said auxiliary steam line having a steam inlet connected to said steam accumulator for allowing steam to be injected into said steam accumulator.

9. A steam generating system as defined in claim 6, wherein said steam generator unit water inlet is connected to said steam accumulator, and said steam generating system comprises a system water inlet connected to said steam accumulator for feeding water thereto, whereby the water fed to said steam generator unit is first mixed with water from the said steam accumulator.

* * * * *